US009383073B2

(12) United States Patent
Frost et al.

(10) Patent No.: US 9,383,073 B2
(45) Date of Patent: Jul. 5, 2016

(54) POWER SUPPLY MODULE, AND LIGHTING STRIP

(75) Inventors: Tobias Frost, Burglengenfeld (DE); Steffen Strauss, Regensburg (DE)

(73) Assignee: OSRAM GmbH, Munich (DE)

( * ) Notice: Subject to any disclaimer, the term of this patent is extended or adjusted under 35 U.S.C. 154(b) by 169 days.

(21) Appl. No.: 13/320,914

(22) PCT Filed: May 17, 2010

(86) PCT No.: PCT/EP2010/056707
§ 371 (c)(1),
(2), (4) Date: Dec. 16, 2011

(87) PCT Pub. No.: WO2010/133535

PCT Pub. Date: Nov. 25, 2010

(65) Prior Publication Data

US 2012/0081889 A1 Apr. 5, 2012

(30) Foreign Application Priority Data

May 19, 2009 (DE) ..... 10 2009 021 846

(51) Int. Cl.
*F21S 4/22* (2016.01)
*F21Y 101/02* (2006.01)

(52) U.S. Cl.
CPC ..... *F21S 4/22* (2016.01); *F21Y 2101/02* (2013.01)

(58) Field of Classification Search
CPC ..... F21S 4/22; F21Y 2101/02
USPC ..... 362/249.02, 249.04, 249.06, 249.08, 362/184, 311.02, 800
See application file for complete search history.

(56) References Cited

U.S. PATENT DOCUMENTS 4,173,035 A * 10/1979 Hoyt ..... 362/249.04
4,439,818 A * 3/1984 Scheib ..... 362/249.06
5,559,681 A * 9/1996 Duarte ..... 362/231
5,903,102 A 5/1999 Klappert et al.
6,582,094 B2 * 6/2003 Liu ..... 362/219
6,739,735 B2 * 5/2004 Talamo et al. ..... 362/237
7,604,376 B2 * 10/2009 Sloan et al. ..... 362/246
8,262,250 B2 * 9/2012 Li et al. ..... 362/219
8,297,788 B2 * 10/2012 Bishop ..... 362/249.02
8,360,608 B2 * 1/2013 Wildner ..... 362/249.04
2006/0207139 A1 9/2006 Deflin et al.
2007/0171640 A1 * 7/2007 Sloan et al. ..... 362/240
2008/0239716 A1 10/2008 Lin

FOREIGN PATENT DOCUMENTS

CN 200972986 Y 11/2007
CN 101109485 A 1/2008
CN 201196352 Y 2/2009
DE 102005025214 A1 8/2006
DE 202006017983 U1 3/2007
JP 2049379 A 2/1990
JP 045903 A 2/2000

OTHER PUBLICATIONS

English abstract of CN201196352Y; Feb. 18, 2009.
English abstract of CN101109485A; Jan. 23, 2008.
English abstract of CN200972986Y; Nov. 7, 2007.
English language abstract of JP 2 049379 A.
English language abstract of DE 10 2005 025214 A1.
English language abstract of DE 20 2006 017983 U1.
English language abstract of JP 045903 A.

* cited by examiner

*Primary Examiner* — Bao Q Truong
(74) *Attorney, Agent, or Firm* — Viering, Jentschura & Partner mbB

(57) ABSTRACT

A power supply module may include an at least partially flexible support; a supply unit arranged on the support; and at least one outlet connection for a lighting module which can be fed by the supply unit.

17 Claims, 2 Drawing Sheets

POWER SUPPLY MODULE, AND LIGHTING STRIP

RELATED APPLICATIONS

The present application is a national stage entry according to 35 U.S.C. §371 of PCT application No: PCT/P2010/056707 filed on May 17, 2010, which claims priority from German application No.: 10 2009 021 846.7 filed on May 19, 2009.

TECHNICAL FIELD

This disclosure relates to a power supply module and a lighting strip including at least one such power supply module and including at least one lighting module.

BACKGROUND

An LED strip which consists of one or more flexible LED modules is known from the LINEARLight Flex range from the Osram GmbH company. Each LED module includes a strip-shaped flexible printed circuit board ("Flex strip" or "Flex board") which is equipped on its front side with light emitting diodes (LEDs). The LED module may be constructed contiguously from standardized basic units, between which the LED module may be divided in order to thereby form correspondingly shorter LED modules. The LED modules may be connected mechanically and electrically to one another and also to a power supply by means of proprietary connectors, for example from the CONNECTSystem range from the Osram GmbH company. The power supply is configured as a separate, housed power supply unit, for example from the OPTOTRONIC range from the Osram GmbH company. The length of an individual, contiguous LED strip is limited because of a drop in the supply voltage as the distance from an infeed point increases.

It is disadvantageous here that the known power supply unit makes it more difficult to install the LED strip in particular on curved surfaces and/or is conspicuous in design terms in this situation.

SUMMARY

Various embodiments avoid the aforementioned disadvantages and e.g. specify a facility for installing lighting strips e.g. on curved surfaces in a simple manner which is more advantageous in design terms.

In various embodiments, a power supply module is proposed which includes: An at least partially flexible support, a supply unit arranged on the support and at least one outlet connection for a lighting module which can be fed by the supply unit. On account of the at least partially flexible support, the power supply module can now likewise be installed simply and visually less conspicuously on curved surfaces than a rigid power supply module. The power supply module can thus be used for supplying one or more lighting modules. The at least partially flexible support can be provided for bending on one or more occasions. The bending can advantageously be characterized by a minimum permitted bending radius, for example of 2 cm.

The at least partially flexible support may include at least two rigid regions which may be angled with respect to one another by way of a flexible region. For example, the rigid regions may exhibit a greater thickness of the same base material than the at least one flexible region. Alternatively, the rigid regions may be flexible regions reinforced at a later time, for example through the addition of layers or plates. An essentially completely flexible support is preferred in order to largely adjust the shape to fit a curved contact surface. In the following, unless expressly stated otherwise, a flexible support may also be understood to be an at least partially flexible support.

The at least one connection may advantageously be configured such that it corresponds to a connection for interconnecting lighting modules. In particular, the connection may be configured such that proprietary connectors, in particular module connectors, may be used. In this situation, a module connector may in particular also be understood to be an independent coupling element which can be inserted between two modules and connects the latter mechanically and/or electrically. It is thus possible to dispense with separate coupling elements between the power supply module and the at least one lighting module.

Alternatively or additionally, the connection may be configured as a coupling element (for example a socket), to which a lighting module may be connected directly (in other words without a module connector). This means that a connector may be dispensed with, which simplifies any installation and any storage. This also creates the unified impression of one lighting strip containing the at least one lighting module and the at least one power supply module because the power supply module is no longer perceived as a unit separate from the at least one lighting module.

In an advantageous development, the support is configured in an elongated fashion. This means that the power supply module may approximate in its handling and/or configuration to a strip-shaped lighting module, which facilitates uniform installation and a uniform configuration.

The support may in particular be configured as a Flex strip or as a Flex film. This permits particularly uniform handling and/or configuration in conjunction with such lighting modules which likewise include a Flex strip and/or a Flex film.

In a development, the support includes at least one inlet electrical and/or mechanical connection for the lighting module. This means that the power supply module may be inserted between at least two lighting modules and may then in particular be used as an intermediate feed unit ("refresher", in particular voltage refresher).

If an inlet electrical but not mechanical connection is present for a lighting module, a mechanical separation may for example be prevented by means of the fact that the power supply module and the lighting module are fixed individually, for example by using a respective adhesive and/or screw fitting.

If an inlet mechanical but not electrical connection is present for a lighting module, a lighting module mechanically connected on the inlet side and a lighting module connected on the outlet side may be operated electrically independently of one another. The power supply module then serves electrically as a feed-in or supply and mechanically as a module connector.

In particular, if an inlet and outlet connection is present the support may advantageously be configured as strip-shaped, whereby the inlet connection may then be present at an end region, in particular of an end face, of the power supply module or support, and an outlet connection may be present at an end region (for example situated opposite), in particular of an end face, of the power supply module or the support thereof. This means that the power supply module may largely correspond in form and arrangement of the connections to a strip-shaped lighting module.

In a further development, at least one connection is configured electrically and/or mechanically so as to be protected against polarity reversal. It is thus possible to further simplify an installation, and to prevent damage to or any impairment of function of the power supply module and/or of the at least one lighting module as a result of a polarity reversal.

Protection against polarity reversal can be achieved for example by means of appropriately arranged and/or electrically switched contacts.

Additionally or alternatively, the protection against polarity reversal may be achieved by means of an appropriate physical embodiment of the connections, for example by means of mechanical elements, for example by using grooves and/or projections in the support or by using asymmetrically configured connections. In one embodiment, a different contacting technology (for example using a screw-type terminal) other than that used at the at least one outlet connection (for example a plug-in connection) can be used at the at least one inlet connection.

The power supply module may moreover include a logic unit for detecting a polarity reversal. The power supply module may then furthermore be set up in order to reconfigure the associated connection in such a manner that it suits the module connected thereto. Additionally or alternatively, the power supply module may be set up so as to output at least one signal in the event of a detected polarity reversal, for example an audible and/or a visual signal. A visual signal may consist in the illumination of at least one indicator element (for example a red LED for indicating a polarity reversal as well as a green LED for indicating connection with correct polarity).

In a further development, a connection may include a plurality of contacts, whereby the connection may provide one or more functions.

The connection may thus include at least two functions, for example provide at least two energy ranges, voltage ranges and/or current ranges. This means that the power supply module may be used on a particularly universal basis. For example, different groups of contacts may be provided with differing functions for each group: For example a power supply for lighting modules set up differently depending on their dimensioning for example with different supply voltage ranges. Depending on the connected contacts, corresponding supply voltages or supply currents are therefore made available to the connected lighting module. By means of the power supply module presented here, different connection types possibly already standardized or to be standardized in the future can thus be correspondingly universally supplied.

Depending on the availability of an inlet connection or an outlet connection, the functions may be different.

Within the framework of an additional development, the power supply module includes at least two outlet connections. This means that the power supply module may be used as a branching point, for example a star point, for the lighting strip.

In a next embodiment, the at least one connection is configured as a ZIF (zero insertion force) connection. This enables particularly fail-safe mechanical and/or electrical contacting.

Fail-safe contacting is supported by the embodiment such that the at least one connection works together functionally with a mechanical interlock or includes a mechanical interlock. The interlock may be configured to be releasable or non-releasable. A possible interlock may be present as a catch mechanism; the power supply module may then for example include a locking projection (for example a locking latch) and/or a locking recess for the introduction of a locking projection.

In a further embodiment, the power supply module includes at least partially on one side an adhesive tape, in particular a double-sided adhesive tape, one side of which adheres on the rear side of the support. This means that a particularly simple fixing of the power supply module may be achieved. The use of an adhesive tape may advantageously be employed in order to attach to a heat sink, for example a cooling element, because in this way it is also possible to achieve a good thermal coupling to the heat sink for cooling the supply unit without requiring preparation of the heat sink.

In order to further improve the heat dissipation the power supply module may include at least one screw element in order to enable a threaded connection, for example one or more through holes for the insertion of screws. By this means it is possible to suppress air gaps which impair a transfer of heat.

In a possible embodiment, the supply unit has a converter. This means that the supply unit may be operated with different or also varying or variable supply voltages, for example a high voltage, a mains voltage and/or a low voltage. This is in particular advantageous because LED modules are designed for certain supply voltage ranges, but these voltage ranges are possibly not available in the case of a user and/or are only available with wide fluctuations (for example in a DC voltage range or AC voltage range).

In general, the converter may include a step-up converter and/or a step-down converter.

By way of example the converter may include one or more inductance based converters: A boost converter, a buck converter and/or a SEPIC (Single Ended Primary Inductance Converter) as a combined step-up/step-down converter. Alternatively or additionally, the converter may include at least one charge pump based step-up converter, step-down converter and/or step-up/step-down converter (so-called "switched capacitor" circuits).

A supply can additionally or alternatively be effected using an AC voltage. In particular, for a supply with AC voltage a rectifier may for example be used which converts the AC voltage into a DC voltage.

In a further embodiment, the power supply module includes at least one light source, in particular a semiconductor light source, specifically a light emitting diode. Any irregularity in a light pattern produced by a lighting strip, in particular in a light source spacing ("pitch"), may thus be made inconspicuous or even avoided completely. This is advantageous in particular with regard to an arrangement of the power supply module between lighting modules.

The at least one light emitting diode may for example at least include one individual LED or at least one LED unit having a plurality of LED chips mounted on a common submount. The light emitting diodes may be white and/or colored.

With regard to a light source having a plurality of differently colored individual LEDs or LED chips it may be preferable if the LED unit emits an essentially white mixed light. It may be advantageous for the purpose of dynamic colored lighting if this LED light source may be color tuned.

As an alternative or in addition to a light emitting diode, a laser diode may for example be used as a semiconductor light source.

The support may be configured as an at least partially flexible printed circuit board for the purpose of simple wiring.

A base material for the support of the power supply module may preferably be a printed circuit board base material, for example polyimide, but also FR (specifically FR4). With regard to an embodiment made of an FR material, a flexibility may for example be achieved by means of a correspondingly small carrier thickness and/or by incorporating bending positions (bending lines, etc.), for example by means of a reduction in the material thickness. Alternatively, it is also possible to use a metal core board which is correspondingly at least partially flexible and intended for bending, which enables good heat dissipation. In general, the support for the power supply module may also essentially be rigid or not intended for bending.

According to a further embodiment, the power supply module may include at least one housing for at least one part of the support and/or of the power supply module. This means that a housed region of the power supply module may be protected, for example against mechanical stress, against dust and/or against moisture. In particular, it is advantageous if at least one electronic component of the supply unit is housed by the housing, preferably all the electronic components of the supply unit and/or of the power supply module.

The housing may for example include a cover which leaves a space free between it and the support, for example a cover formed by means of a transparent film.

Alternatively, the housing may include a potting compound which may be manufactured particularly inexpensively and simply. In this situation, an at least partially flexible or bendable cover is preferred.

The use of silicone as a potting compound may be advantageous because silicone is flexible, translucent, provides a seal and is resistant to ageing to a high degree.

In order to apply the potting compound, the power supply module may for example be introduced into a potting mold and then be cast using the potting compound. A conceivable potting mold is for example a flexible profile rail, for example having a U-shaped or C-shaped cross-section in which the lighting strip is first secured and is then molded. The potting mold may be removed after the potting compound has at least largely cured, or it may be retained and may then constitute an inseparable part of the power supply module and/or lighting module. The profile may be produced from silicone.

The housing, in particular potting compound, may advantageously be electrically conductive because it is thereby possible to achieve shielding at least of a part of the supply unit or at least of a part of its electronic components. The power supply module may thereby be protected for example against an electrostatic discharge (ESD) or satisfy a predetermined electromagnetic compatibility (EMC) requirement. For example, a metal film may also be cast in the potting compound. Alternatively or additionally, the potting compound may itself be electrically conductive, for example through the use of an electrically conductive filler material.

To provide improved heat dissipation from the supply unit, the potting compound may additionally or alternatively be thermally conductive, for example through the use of a thermally conductive filler material.

The aforementioned object is also achieved by a lighting strip including at least one power supply module according to one of the preceding claims and at least one lighting module.

In one development, the lighting module includes a strip-shaped support having at least one light source arranged thereon, and the width of the support of the at least one power supply module and the width of the support of the at least one lighting module are essentially the same. This means that a particularly uniform embodiment of the lighting strip may be achieved. Moreover, the at least one power supply module may thereby be installed or handled in the same manner as the at least one lighting module. For example, the at least one power supply module may be installed in the same rail, profile, recess (for example groove or depression), etc. as the lighting module. This means that the lighting strip may for example also be processed uniformly without any need for adaptation, for example installed and/or potted as a contiguous unit in a profile.

Advantageously, the support of the at least one power supply module may essentially correspond to the support of the at least one lighting module amongst other things with regard to its base material, its width, its thickness and/or other properties, such as a maximum bending radius. This means that it is possible to achieve a high degree of convergence with the mechanical properties of the modules.

It may also be advantageous if the length of the support of the at least one power supply module essentially corresponds to the length of a basic unit of a lighting module, or to a multiple thereof because the supports of power supply module and lighting module may thereby originate from the same manufacturing process.

In a further development, the at least one power supply module includes a plurality of light sources, whereby adjacent light sources exhibit essentially the same spacing with respect to one another as adjacent light sources of the at least one lighting module. This means that any irregularity in a lighting pattern, in particular in the light source spacing ("pitch"), of the lighting strip may be reduced or even avoided completely. To this end, it is particularly advantageous if a spacing between a light source arranged on the outside to an end of the support corresponds to the corresponding spacing of the lighting module. This means that a spacing of two light sources of adjacent lighting modules and power supply modules may be configured uniformly.

In accordance with a further embodiment, the power supply module may be connected integrally with the at least one lighting module, for example integrated in a finished lighting strip. The power supply module and the at least one lighting module can then preferably be separated from one another subsequently. The power supply module could for example be provided as a first and/or as a last module on a roll containing lighting strip. The power supply module may also initially be present simply with an unequipped support, whereby the component parts of the power supply module (supply unit, etc.) then only need to be equipped as an "equipping option" if their functionality is needed or desired. Alternatively, the equipping of a power supply module may be provided as an alternative or in addition to a normal equipping with light sources.

It may be advantageous for simple manufacturing of a lighting strip integrated in this way if the length and where applicable the basic construction of the support of the power supply module corresponds to the length and where applicable the basic construction of the support of the lighting module because the support may thereby be produced simply in an endless strip manufacturing process (for example in a reel-to-reel manufacturing process) and may then be equipped particularly simply.

BRIEF DESCRIPTION OF THE DRAWINGS

Exemplary embodiments of the invention will be illustrated schematically and described in the following with reference to the drawings. In this situation, the same elements or elements having the same function are identified by the same reference characters for improved clarity.

In the drawings.

DETAILED DESCRIPTION

The following detailed description refers to the accompanying drawings that show, by way of illustration, specific details and embodiments in which the invention may be practiced.

Figure 1:
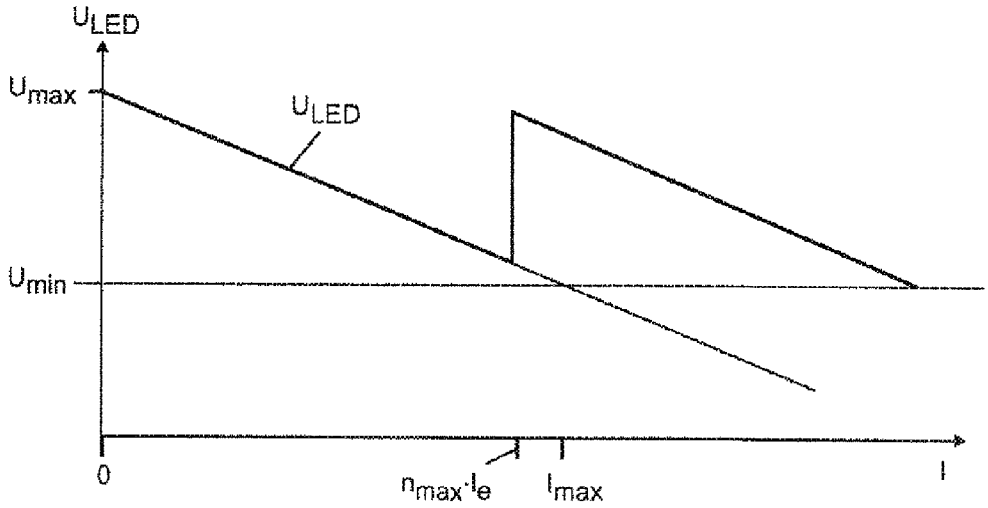
FIG. 1 shows the course of a supply voltage over a length of a lighting module.

FIG. 1 shows the course of a supply voltage $U_{LED}$ provided for supplying a light source of a strip-shaped lighting module over a length 1 of the lighting module.

In this situation it is assumed that an end-face inlet connection of the lighting module, which is situated at the length l=0, is connected to a power supply module. The maximum supply voltage $U_{max}$ is therefore present at the end face of the lighting module when l=0. With the increasing length l of the lighting module or a corresponding spacing from an infeed point, the level of the supply voltage $U_{LED}$ falls, represented here in linear fashion for the sake of simplicity, on account of voltage drops over current lines and light sources. At the maximum supply length $l_{max}$ of the lighting module, the level of the supply voltage $U_{LED}$ has dropped to a minimum supply voltage $U_{min}$ which is still just sufficient for supplying a light source. In other words, without further measures no light source can be reliably operated which has a spacing from the inlet connection greater than the maximum supply length $l_{max}$. The maximum effective length of a lighting module would thus be restricted to the maximum supply length $l_{max}$.

In order to extend the maximum possible length l of a lighting module, an intermediate feed unit or a refresher may be inserted into the lighting module if the lighting module may be divided. For the case that the lighting module includes $n \geq 2$ basic units each having a length $l_e$, between which the lighting module may be separated, in order to extend the lighting module an intermediate feed unit should be inserted at the latest after the $n_{max}$-th basic unit, whereby $n_{max} \cdot l_e < l_{max}$ applies. By means of the intermediate feed unit it is possible to essentially raise the supply voltage $U_{LED}$ again at an inlet connection of the $(n_{max}+1)$-th basic unit to the maximum supply voltage $U_{max}$. Consequently the length l of the lighting module may be extended by a further $n_{max}$ basic units, corresponding to an additional length of approx. $n_{max} \cdot l_e$.

Figure 2:
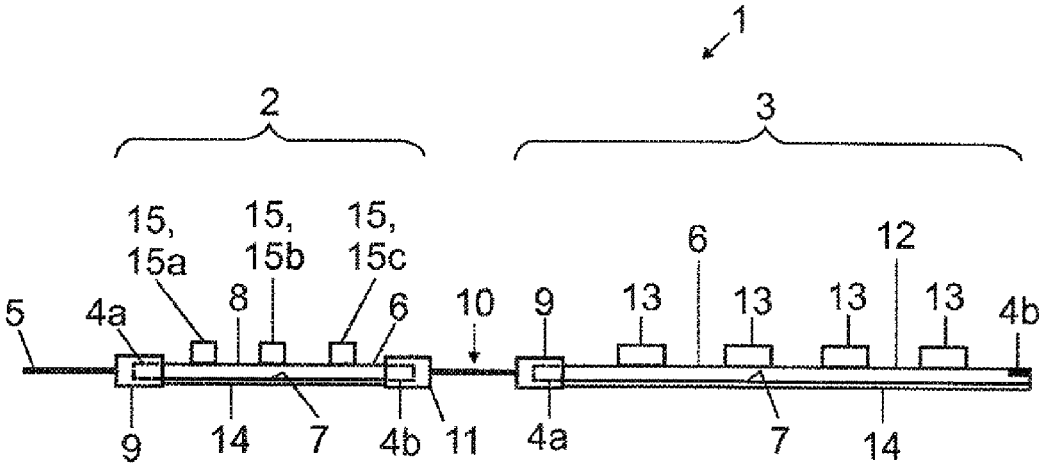
FIG. 2 shows a side view of a lighting strip according to a first embodiment.

FIG. 2 shows a lighting strip 1 which includes a power supply module 2 and a lighting module in the form of an LED module 3. At its here left-hand end face the power supply module 2 has an inlet connection in the form of an inlet plug connector 4*a*, whereby the inlet plug connector 4*a* is connected to an external voltage source (not shown) by way of a feed cable 5. The inlet plug connector 4*a* may be configured such that it includes contacts (not shown) arranged on the end face, which are arranged on a front side 6 of a support 8 of the power supply module 2. For contacting the inlet plug connector 4*a*, the feed cable 5 includes a suitable socket 9.

On the opposite end face the power supply module 2 includes an outlet connection in the form of an outlet plug connector 4*b*, which likewise includes contacts (not shown) arranged on the end face, which may likewise be arranged on a front side 6 of the support 8. On the outlet plug connector 4*b* is connected a connector in the form of a module connector 10, by way of which the power supply module 2 and the LED module 3 are connected to one another mechanically and electrically. For contacting the outlet plug connector 4*b*, the module connector 10 includes a suitable socket 11. Furthermore, the module connector 10 includes a suitable socket 9 for contacting an inlet plug connector 4*a* of the LED module 3. The inlet plug connectors 4*a* of the power supply module 2 and the LED module 3 are of identical construction, and the outlet plug connectors 4*b* of the power supply module 2 and the LED module 3 are also of identical construction. This means that the same module connectors 10 may be used for contacting the power supply module 2 and the LED module 3 as for connecting two LED modules 3. In order to prevent a polarity reversal the plug connectors 4*a*, 4*b* may be configured asymmetrically with respect to one another. The plug connectors 4*a*, 4*b* may be designed as ZIF (zero insertion force) plug connectors 4*a*, 4*b*.

The LED module 3 includes a strip-shaped flexible support 12, the upper side 6 of which is equipped with light emitting diodes 13. The rear side 7 of the LED module 3 is fitted with an adhesive tape 14 in order to affix the LED module 3 in a flat fashion in a simple manner, for example on a heat sink (not shown here). The LED module 3 or the support 12 thereof may be bent as far as a minimum bending radius of approx. 2 cm in order to thereby also enable simple installation on highly curved surfaces.

The power supply module 2 is constructed similarly to the LED module 3, whereby the support 8 of the power supply module 2 and the support 12 of the LED module 3 may differ only in respect of a length and where applicable of a wiring pattern and also of possible arranged components. The support 8 and the support 12 have for example the same base material, the same thickness, the same width and the same minimum bending radius. The support 8 can be present in particular in the form of a Flex film.

Instead of the light emitting diodes 13 of the LED module 3, on the front side 6 of the support 8 of the power supply module 2 are mounted electronic components 15*a*, 15*b*, 15*c* which constitute a supply unit for the LED module 3 in the form of a converter 15, whereby the converter 15 converts a voltage from the external voltage source into the supply voltage $U_{LED}$ for operating the light emitting diodes 13.

Instead of the embodiment described above of the power supply module as a terminal feeder, the power supply module may alternatively or additionally be designed as an intermediate feed unit. At the inlet plug connector 4*a*, instead of the external current source a further LED module 3 could then be connected mechanically and/or electrically, namely by way of a further module connector. The power supply module may then include a further inlet connection for an external voltage source.

Figure 3:
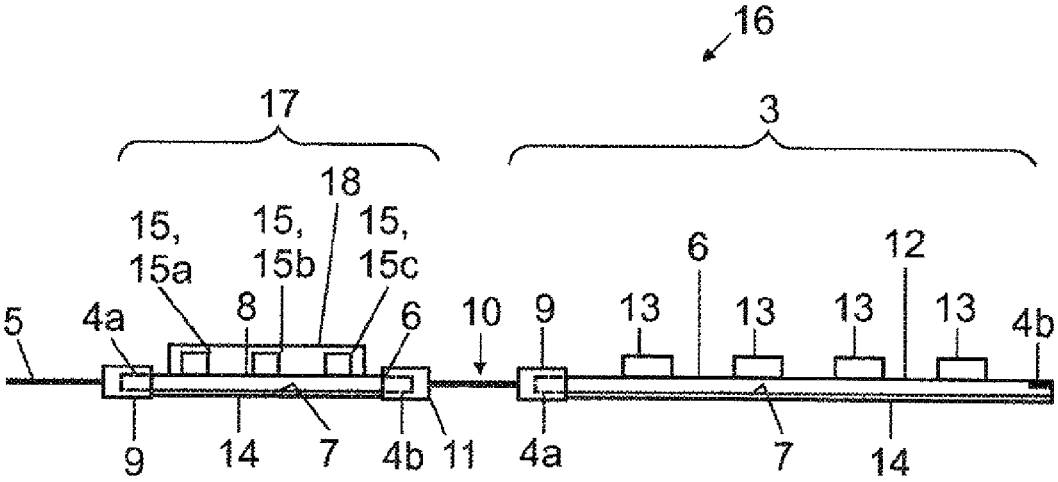
FIG. 3 shows a side view of a lighting strip according to second embodiment.

FIG. 3 shows a lighting strip 16 according to a second embodiment, wherein in this instance in contrast to the lighting strip 1 of the first embodiment at least the electronic components 15*a* to 15*c* of a power supply module 17 are housed by means of a housing in the form of a potting compound 18. The potting compound 18 consists here of opaque silicone. Since silicone is flexible, the flexibility of the power supply module 17 is maintained. In addition, the electronic components 15*a* to 15*c* are protected by the potting compound 18 for example against dust and/or moisture. The electronic components 15*a* to 15*c* may also be opaquely concealed, which results in a higher-quality appearance. In this situation, the color of the potting compound 18 may be matched closely to the color of the support 8 in order to achieve a particularly unobtrusive solution in design terms.

Figure 4:
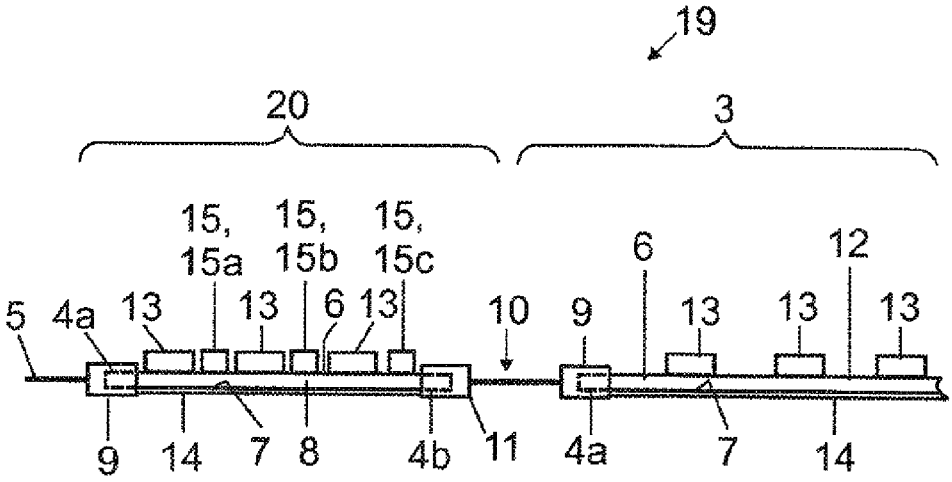
FIG. 4 shows a side view of a lighting strip according to a third embodiment.

FIG. 4 shows a lighting strip 19 according to a third embodiment, wherein in this instance in contrast to the lighting strip 1 of the first embodiment apart from the electronic components 15*a* to 15*c* light emitting diodes 13 are additionally mounted on the front side 6 of the support 8 of a power supply module 20. The light emitting diodes 13 mounted on the support 8 of the power supply module 20 have the same spacing ("pitch") as the light emitting diodes 13 mounted on the support 12 of the LED module 3. This means that any irregularity in a lighting arrangement and thus in an associated radiation pattern resulting from the use of the power supply module 20 can be reduced or eliminated.

The invention is however not restricted to the exemplary embodiments shown.

A power supply module and an LED module may thus also be connected to one another directly without a module connector, for example with one of the modules having a plug connector and the other module having a suitable socket (for example where the socket is affixed to the support). The power supply module may also be configured as a branch; in particular the form of the power supply module or the support thereof can then differ from a strip form.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE CHARACTERS

1 Lighting strip
2 Power supply module
3 LED module
4*a* Inlet-side connector
4*b* Outlet-side connector
5 Feed cable
6 Front side
7 Rear side
8 Support of the power supply module
9 Socket
10 Module connector
11 Socket
12 Support of the LED module
13 Light emitting diode
14 Adhesive tape
15 Converter
15*a* Electronic component of the converter
15*b* Electronic component of the converter
15*c* Electronic component of the converter
16 Lighting strip
17 Power supply module
18 Potting compound
19 Lighting strip
20 Power supply module
$U_{LED}$ Supply voltage
$U_{max}$ Maximum supply voltage
$U_{min}$ Minimum supply voltage
$l_e$ Length of a basic unit
$l_{max}$ Maximum supply length
$n_{max}$ Maximum number of suppliable basic units

The invention claimed is:

1. A power supply module, comprising:
an at least partially flexible support;
a supply unit arranged on the support; and
at least one outlet connection for a lighting module which can be fed by the supply unit;
wherein the partially flexible support has a minimum permitted bending radius of 2 cm.

2. The power supply module as claimed in claim 1, wherein the support is configured in an elongated fashion.

3. The power supply module as claimed in claim 1, wherein the support comprises at least one of at least one inlet electrical and at least one mechanical connection for the lighting module.

4. The power supply module as claimed in claim 1, wherein at least one connection is configured at least one of electrically and mechanically so as to be protected against polarity reversal.

5. The power supply module as claimed in claim 1, which comprises at least one connection providing at least two functions.

6. The power supply module as claimed in claim 1, which comprises at least two outlet connections.

7. The power supply module as claimed in claim 1, at least one connection of which is configured as a zero insertion force connection.

8. The power supply module as claimed in claim 1, which comprises on one side an adhesive tape.

9. The power supply module as claimed in claim 1, which comprises at least one light source.

10. The power supply module as claimed in claim 1, wherein the supply unit comprises a converter.

11. The power supply module as claimed in claim 1, further comprising: at least one housing for at least one part of at least one of the support and of the power supply module.

12. A lighting strip, comprising; at least one power supply module, the power supply module comprising: an at least partially flexible support; a supply unit arranged on the support; and at least one outlet connection for a lighting module which can be fed by the supply unit; and at least one lighting module; wherein the partially flexible support has a minimum permitted bending radius of 2 cm.

13. The lighting strip as claimed in claim 12, wherein the support of the power supply module is configured in an elongated fashion, wherein the lighting module comprises a strip-shaped support having at least one light source arranged thereon, and the width of the support of the at least one lighting module and the width of the support of the at least one power supply module are essentially the same.

14. The lighting strip as claimed in claim 12, wherein the at least one power supply module further comprises a plurality of light sources, whereby adjacent light sources are configured to exhibit essentially the same spacing as adjacent light sources of the at least one lighting module.

15. The lighting strip as claimed in claim 12, wherein the power supply module is connected integrally with at least one lighting module.

16. The power supply module as claimed in claim 2, wherein the support is configured as a flex film.

17. The power supply module as claimed in claim 9, wherein the at least one light source comprises at least one light emitting diode.

* * * * *